US011189956B2

(12) United States Patent
Tanimura et al.

(10) Patent No.: US 11,189,956 B2
(45) Date of Patent: Nov. 30, 2021

(54) LIQUID-TIGHT MOVABLE CONNECTOR

(71) Applicant: Sumitomo Wiring Systems, Ltd., Yokkaichi (JP)

(72) Inventors: Shunsuke Tanimura, Yokkaichi (JP); Ryotaro Ishikawa, Yokkaichi (JP); Satoru Nishide, Yokkaichi (JP); Yuki Hirose, Yokkaichi (JP); Tomoaki Yasuda, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/992,252

(22) Filed: Aug. 13, 2020

(65) Prior Publication Data

US 2021/0066847 A1 Mar. 4, 2021

(30) Foreign Application Priority Data

Aug. 26, 2019 (JP) ..... JP2019-153393

(51) Int. Cl.
*H01R 13/52* (2006.01)
*H01R 13/502* (2006.01)

(52) U.S. Cl.
CPC ..... *H01R 13/5202* (2013.01); *H01R 13/502* (2013.01)

(58) Field of Classification Search
CPC ..... H01R 13/5202; H01R 13/502; H01R 13/62938; H01R 13/516; H01R 13/5219
USPC ..... 439/271
See application file for complete search history.

(56) References Cited

U.S. PATENT DOCUMENTS

2001/0039144 A1* 11/2001 Osawa ..... H01R 13/5202 439/589
2006/0270255 A1* 11/2006 Ishikawa ..... H01R 13/4538 439/141
2012/0009809 A1* 1/2012 Kataoka ..... H01R 13/521 439/271
2014/0206213 A1* 7/2014 Kato ..... H01R 13/62 439/157
2017/0117660 A1* 4/2017 Furuya ..... H01R 13/4538
2018/0083385 A1* 3/2018 Akagi ..... H01R 13/62938
2018/0109033 A1* 4/2018 Tashiro ..... H01R 13/501
2018/0109036 A1* 4/2018 Akagi ..... H01R 13/641
2019/0372269 A1* 12/2019 Hirota ..... H01R 13/5219
2020/0153162 A1* 5/2020 Mamiya ..... H01R 13/4223
2021/0066847 A1* 3/2021 Tanimura ..... H01R 13/5219
2021/0066850 A1* 3/2021 Tanimura ..... H01R 13/4538

FOREIGN PATENT DOCUMENTS

JP 2013-157148 8/2013

* cited by examiner

*Primary Examiner* — Abdullah A Riyami
*Assistant Examiner* — Nelson R. Burgos-Guntin
(74) *Attorney, Agent, or Firm* — Gerald E. Hespos; Michael J. Porco; Matthew T. Hespos

(57) ABSTRACT

It is aimed to provide a connector capable of ensuring predetermined sealability. A connector is provided with a housing connectable to a mating housing, a seal to be mounted into the housing, and a moving member movable with respect to the housing. The seal has a sealing surface to be held in close contact with the mating housing. The moving member is arranged at a position facing the sealing surface of the seal before connection of the both housings.

16 Claims, 9 Drawing Sheets

LIQUID-TIGHT MOVABLE CONNECTOR

BACKGROUND

Field of the Invention

This disclosure relates to a connector.

Related Art

Japanese Unexamined Patent Publication No. 2013-157148 discloses a connector with housing connectable to a mating housing. The housing includes a tubular receptacle and a seal ring is mounted on the inner peripheral surface of the receptacle. If the housing is fit into the mating housing, the seal ring is held resiliently in close contact with the outer peripheral surface of the mating housing. The seal ring is sandwiched between the housings to seal between the connectors in a liquid-tight manner.

The seal ring is exposed in the receptacle and the inner peripheral surface to be held in close contact with the mating housing is not protected before the housings are connected. Thus, if foreign matter, such as dust and dirt, adhere to the inner peripheral surface of the seal ring, the inner peripheral surface of the seal ring may be scratched or the foreign matter may be sandwiched between the seal ring and the mating housing. As a result, the sealing ability of the connector is impaired.

Accordingly, it is aimed to provide a connector capable of ensuring predetermined sealing.

SUMMARY

This disclosure is directed to a connector with a housing connectable to a mating housing and a seal to be mounted into the housing. The seal has a sealing surface to be held in close contact with the mating housing. A moving member is movable with respect to the housing and is arranged at a position facing the sealing surface of the seal before connection of the housings.

The moving member faces the sealing surface of the seal before the connection of the housings and the sealing surface is protected. Thus, foreign matter, such as dust and dirt, cannot adhere to the sealing surface. As a result, a state where the sealing surface of the seal is in close contact with the mating housing can be realized satisfactorily. Further, according to this configuration, the moving member can be pressed by the mating housing to move away from the sealing surface. Thus, a special working process for moving the moving member is unnecessary, and work efficiency can be improved.

The housing may include a tubular receptacle, and a tab may project into the receptacle. The seal may be arranged along an inner periphery of the receptacle. The moving member is a moving plate to be assembled into the receptacle and includes a protection wall for protecting a tip of the tab at a protection position before the connection of the housings and a peripheral wall facing the sealing surface on an outer peripheral side of the protection wall. According to this configuration, the moving member has a function of protecting the seal and also a function of protecting the tab. Thus, the structure of the connector can be simplified as compared to the case where a dedicated moving member is provided separately from the moving plate.

The housing may include a restricting portion for restricting forward and rearward movements of the seal in a moving direction of the moving member. According to this configuration, inadvertent forward and rearward movements of the seal can be prevented.

A deformation amount of the seal held in close contact with the mating housing to be resiliently deformed may be larger than that of the seal when the moving member contacts the sealing surface of the seal before the connection of the housings. According to this configuration, the seal is not deformed more than necessary when the moving member contacts the seal before the connection of the housings, and a sealing force (resilient force) of the seal can be prevented from decreasing.

DETAILED DESCRIPTION

A specific example of the connector of this disclosure is described below with reference to the drawings. Note that the invention is not limited to these illustrations and is defined by the claims and include all changes in the scope of equivalents.

Figure 1:
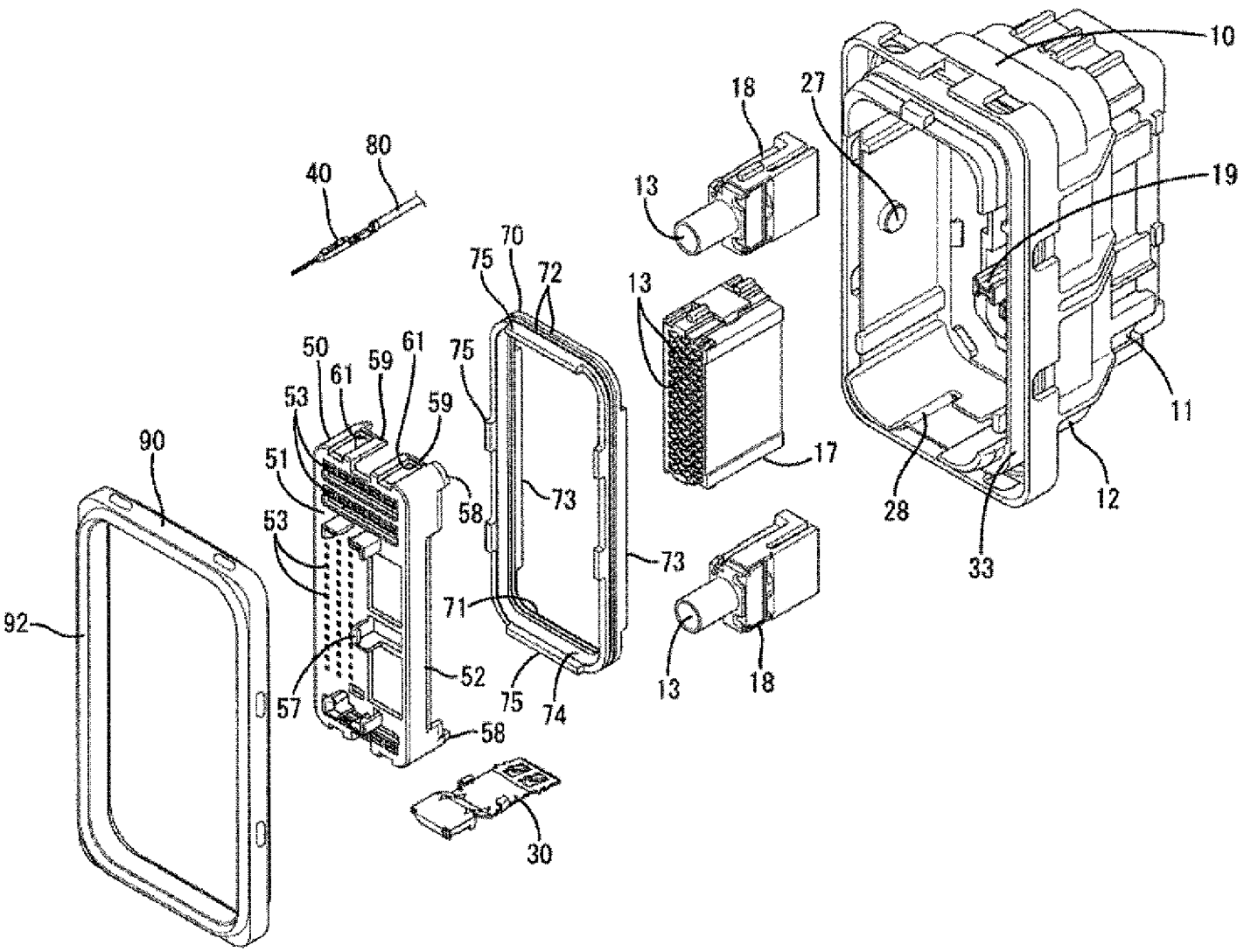
FIG. 1 is an exploded perspective view of a connector.
Figure 6:
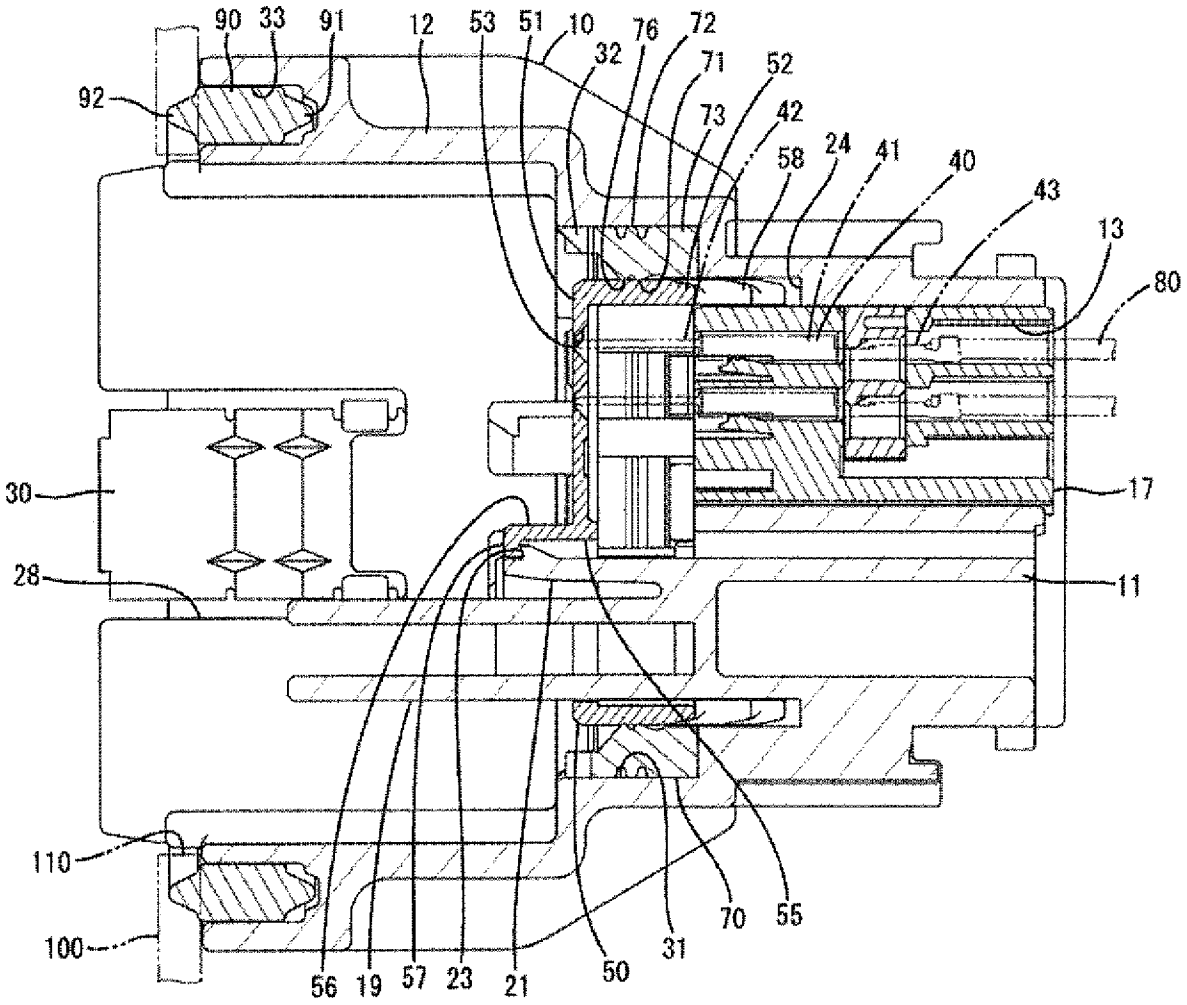
FIG. 6 is a section showing a state where the moving plate is held at a protection position with respect to a housing.

A connector according to an embodiment includes, as shown in FIGS. 1 and 6, a housing 10, terminal fittings 40 to be accommodated in the housing 10, a moving plate 50 serving as a moving member arranged movably with respect to the housing 10, and a seal 70 and a panel seal 90 to be mounted into the housing 10. The connector is mounted on a panel 100, such as a door panel of an automotive vehicle. The housing 10 is connectable to a mating connector 200. In the following description, surfaces facing each other at the start of connection of both connectors are referred to as front ends concerning a front-rear direction.

<Mating Connector>

Figure 2:
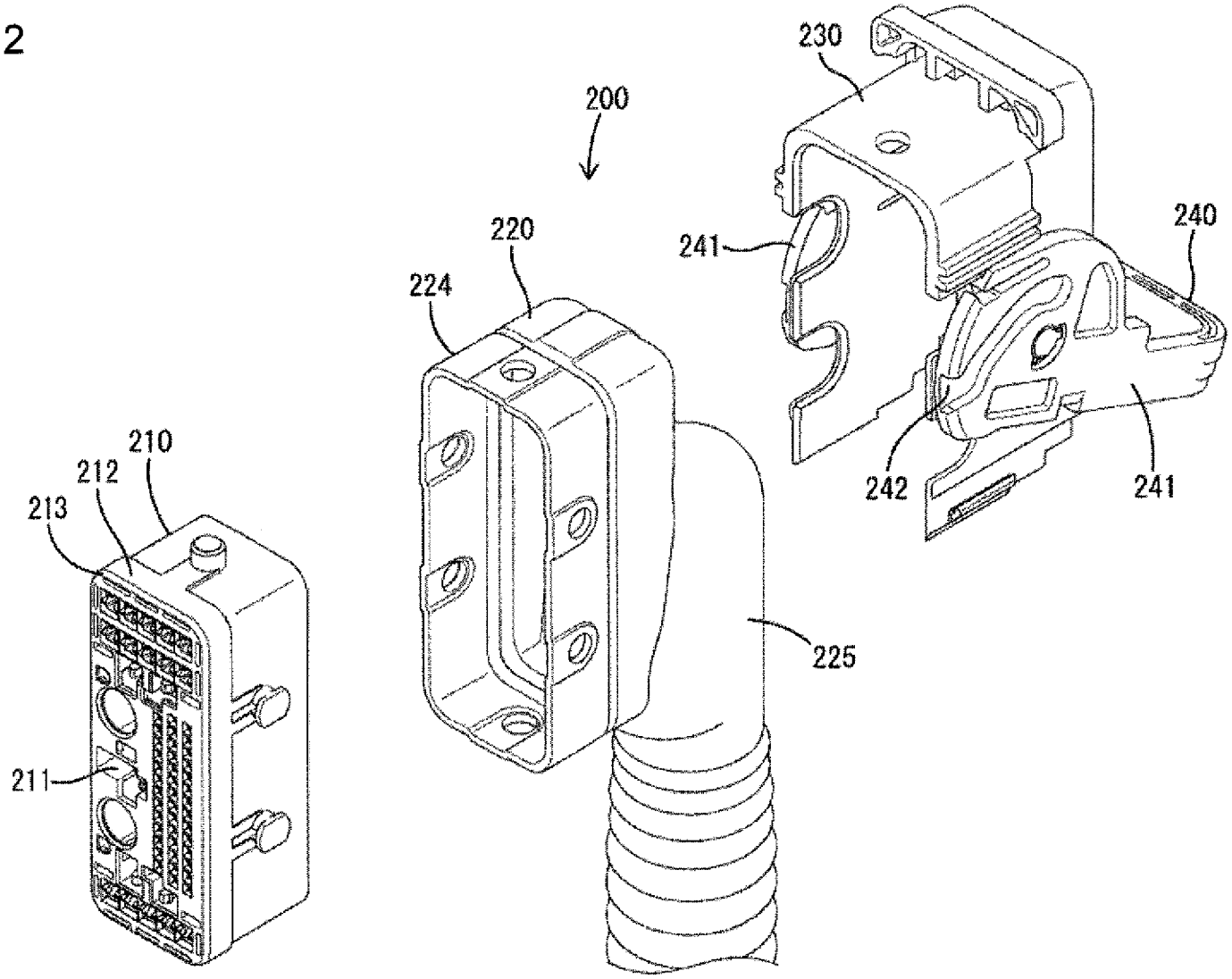
FIG. 2 is an exploded perspective view of a mating connector.

As shown in FIG. 2, a mating connector 200 includes a mating housing 210, a grommet 220 and a grommet cover 230 to be mounted on the mating housing 210, and a lever 240 to be supported rotatably on the grommet cover 230.

Figure 9:
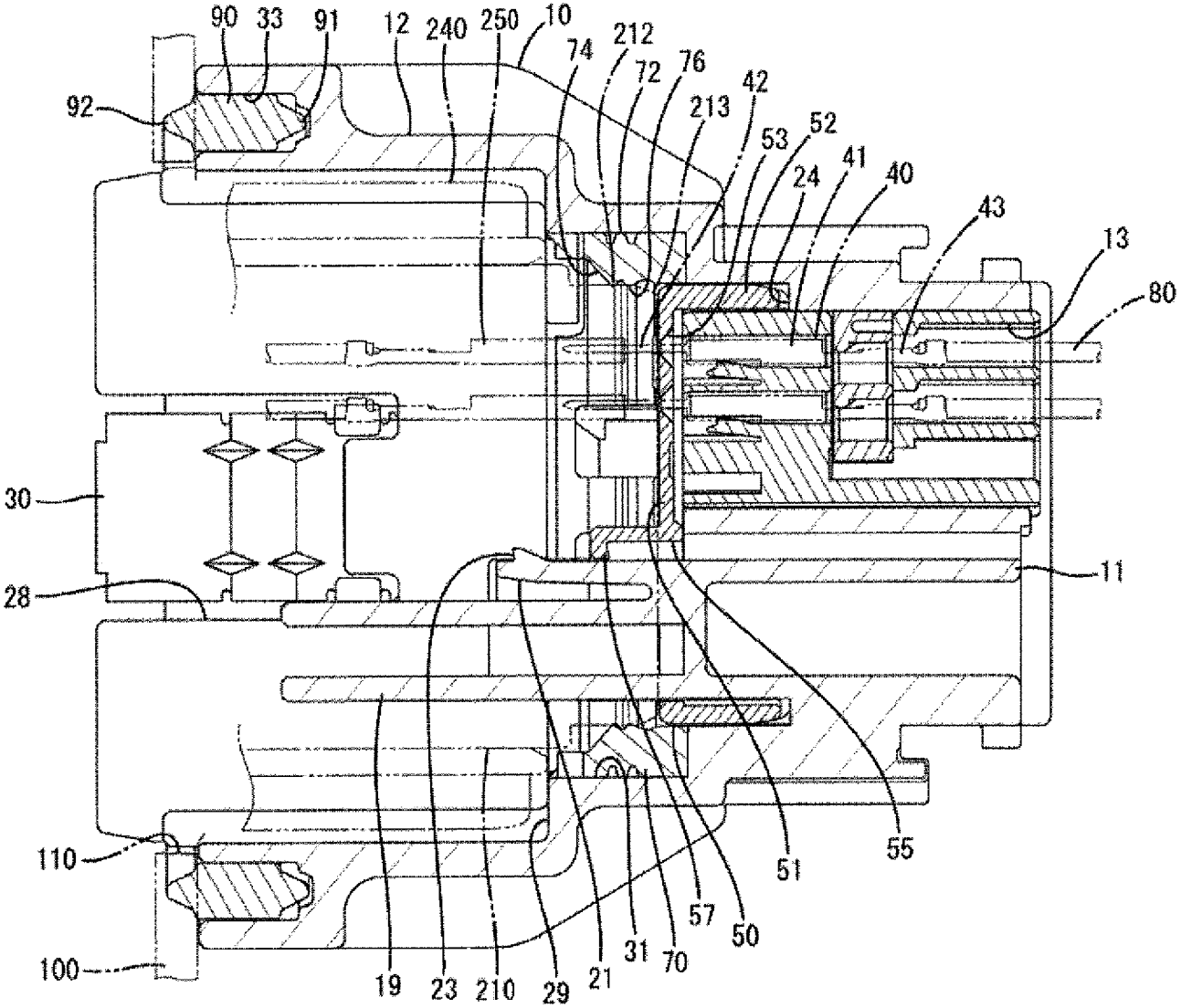
FIG. 9 is a section showing a state where the moving plate is held at a connection position with respect to the housing.

The mating housing 210 is made of synthetic resin and is in the form of a vertically long rectangular block. Unillustrated mating sub-housings can be accommodated into the mating housing 210. As shown in FIG. 9, mating terminal fittings 250 are inserted into and accommodated in the mating housing 210.

As shown in FIG. 2, a receiving portion 211 is recessed in a front surface of the mating housing 210. Further, the mating housing 210 includes an unillustrated trapezoidal releasing portion projecting on the inner surface of the receiving portion 211.

The mating housing 210 has a flat seal receiving surface 212 along the front-rear direction over the entire periphery and a tapered guiding surface 213 inclined inward from the seal receiving surface 212 to the front surface of the mating housing 210 on the outer peripheral surface of a front part.

The grommet 220 is made of rubber and includes a tubular covering portion 224 for covering the outer periphery of the mating housing 210 and a pipe 225 for covering wires drawn out from the mating housing 210. The covering portion 224 of the grommet 220 is in close contact with a region of the outer peripheral surface of the mating housing 210 behind the seal receiving surface 212. The grommet cover 230 is made of synthetic resin and holds the grommet 220 by sandwiching the grommet 220 between the mating housing 210 and the grommet cover 230.

The lever 240 is a U-shaped member made of synthetic resin and is mounted to straddle over the grommet cover 230 from behind. The lever 240 includes two cam plates 241 facing each other in a width direction. Each cam plate 241 includes a cam groove 242 in an outer surface.

<Housing 10>

Figure 3:
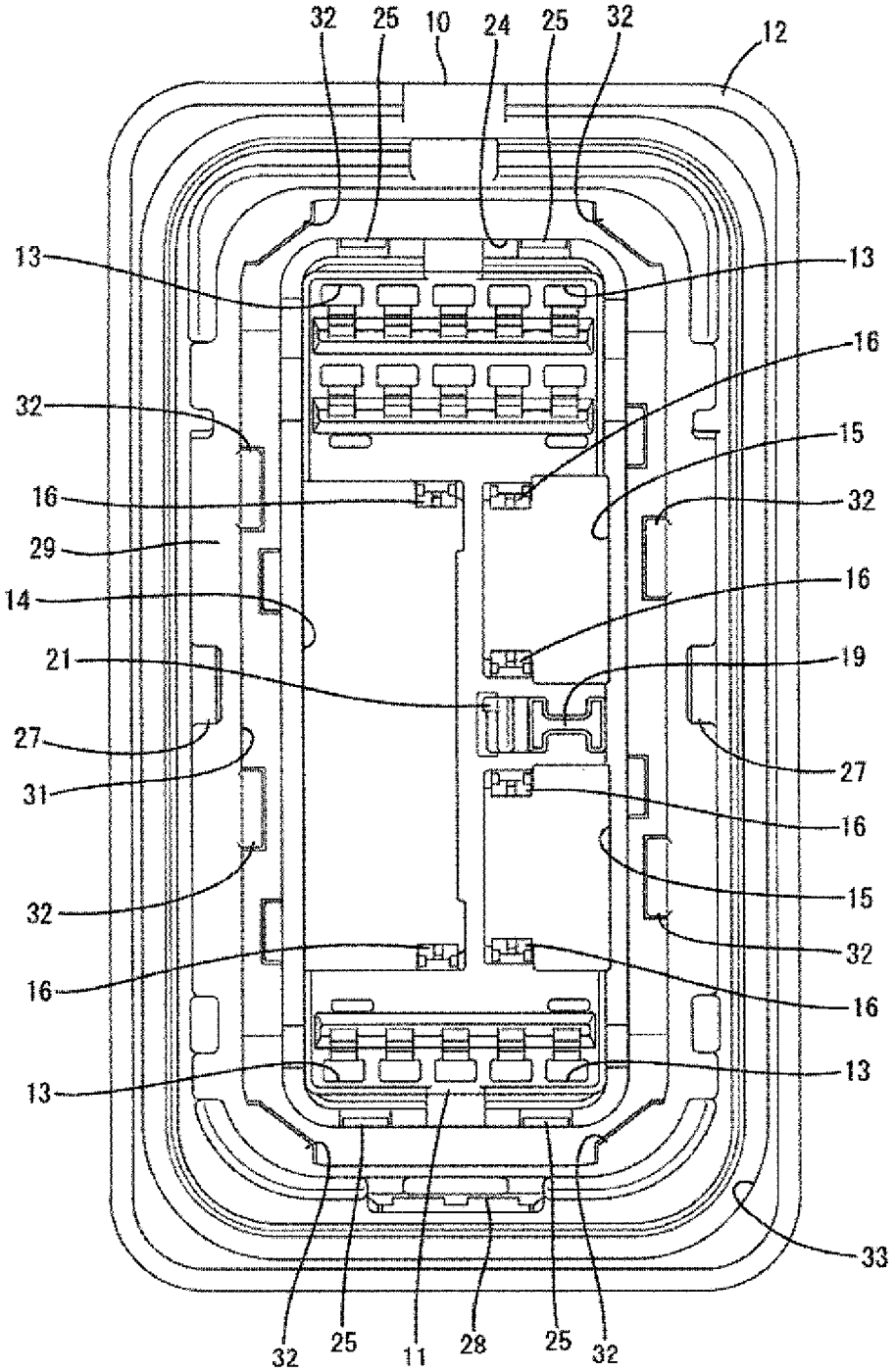
FIG. 3 is a front view of a housing body.

The housing 10 is made of synthetic resin and includes, as shown in FIGS. 1 and 3, a housing body 11 and a receptacle 12 projecting forward from the outer periphery of the front end of the housing body 11.

As shown in FIG. 3, the housing body 11 is vertically long and includes cavities 13 in upper and lower parts. The housing body 11 includes first and second sub-housing accommodating portions 14, 15 penetrating in the front-rear direction in a vertically intermediate part. The first sub-housing accommodating portion 14 has a vertically long rectangular opening arranged on one side (left side of FIG. 3) of the housing body 11 in the width direction. Upper and lower second sub-housing accommodating portions 15 have rectangular opening and are arranged on the other side (right side of FIG. 3) adjacent to the first sub-housing accommodating portion 14 in the width direction. Each of the first and second sub-housing accommodating portions 14, 15 includes housing locks 16 at positions near a widthwise center of the housing body 11 on upper and lower surfaces.

As shown in FIG. 6, a first sub-housing 17 is accommodated into the first sub-housing accommodating portion 14, and a second sub-housing 18 (see FIG. 1) is accommodated into the second sub-housing accommodating portion 15. The first sub-housing 17 includes cavities 13, as shown in FIG. 1, and the second sub-housing 18 includes one cavity 13. The housing locks 16 lock the first and second sub-housings 17, 18 to restrict escape of the first and second sub-housings 17, 18 from the first and second sub-housing accommodating portions 14, 15.

A terminal having a corresponding shape is inserted into each cavity 13 in the housing body 11 and the first and second sub-housings 17, 18. The terminal for general wire (hereinafter, referred to as the terminal fitting 40 (see FIG. 6)) is inserted and accommodated into each cavity 13 in the housing body 11 and the first sub-housing 17. An unillustrated coaxial terminal for coaxial cable is inserted and accommodated into the cavity 13 of the second sub-housing 18.

As shown in FIGS. 3 and 6, the housing body 11 includes a projection 19 projecting into the receptacle 12 between the first and second sub-housing accommodating portions 14, 15 on the front surface. The projection 19 is inserted into the receiving portion 211 of the mating housing 210 when the housings 10, 210 are connected in proper postures. On the other hand, the projection 19 is not inserted into the receiving portion 211 and interferes with the outer surface of the mating housing 210 if an attempt is made to connect the housings 10, 210 in improper postures, thereby preventing erroneous connection of the housings 10, 210.

Figure 7:
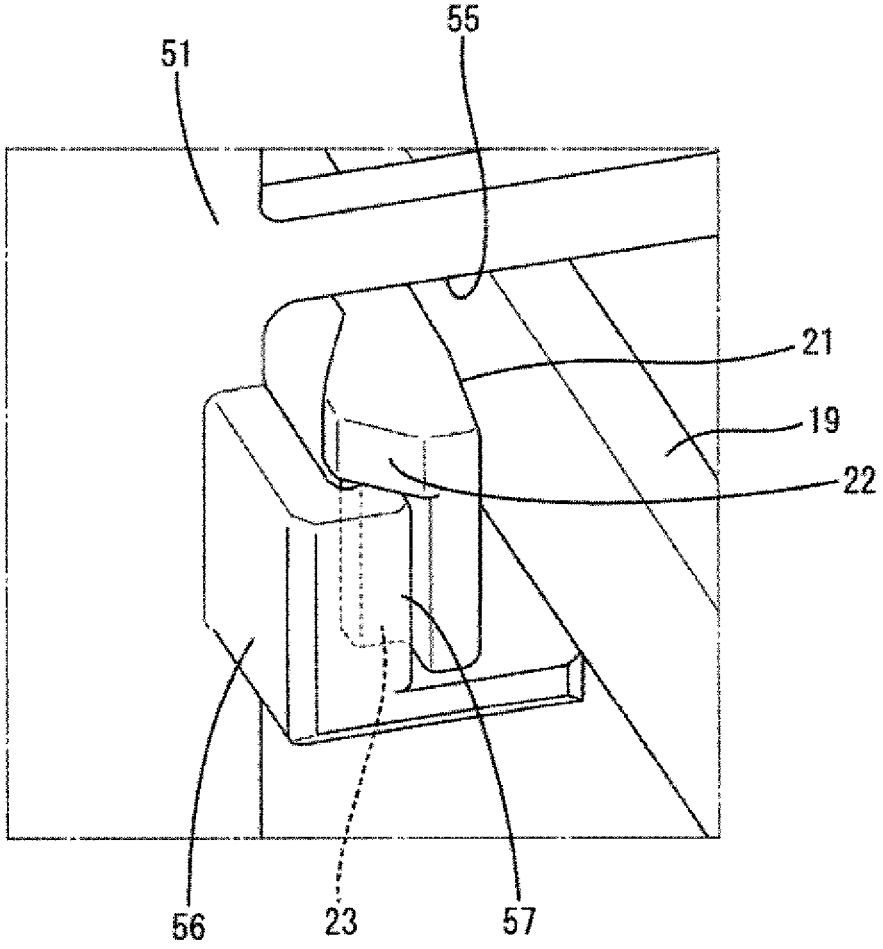
FIG. 7 is an enlarged perspective view showing a state where a locking portion is in contact with a locking surface of a locking arm to restrict a rearward movement of the moving plate.

The housing body 11 includes a locking arm 21 projecting into the receptacle 12 at a position adjacent to the projection 19 on the front surface. A forward projecting dimension of the locking arm 21 is smaller than that of the projection 19. The locking arm 21 is deflectable and deformable with a side near the front surface of the housing body 11 as a fulcrum. As shown in FIG. 7, the locking arm 21 has a release guiding surface 22 and a locking surface 23 vertically arranged on a part projecting toward one widthwise side (side opposite to the projecting portion 19) on a tip part. The release guiding surface 22 has a smaller vertical dimension than the locking surface 23 on a side above the locking surface 23. The release guiding surface 22 is sloped to incline rearward toward the one widthwise side on the front surface of the tip of the locking arm 21. As shown in FIG. 6, the locking surface 23 has an overhanging shape inclined forwardly toward the one widthwise side on the front surface of the tip part of the locking arm 21.

Figure 8:
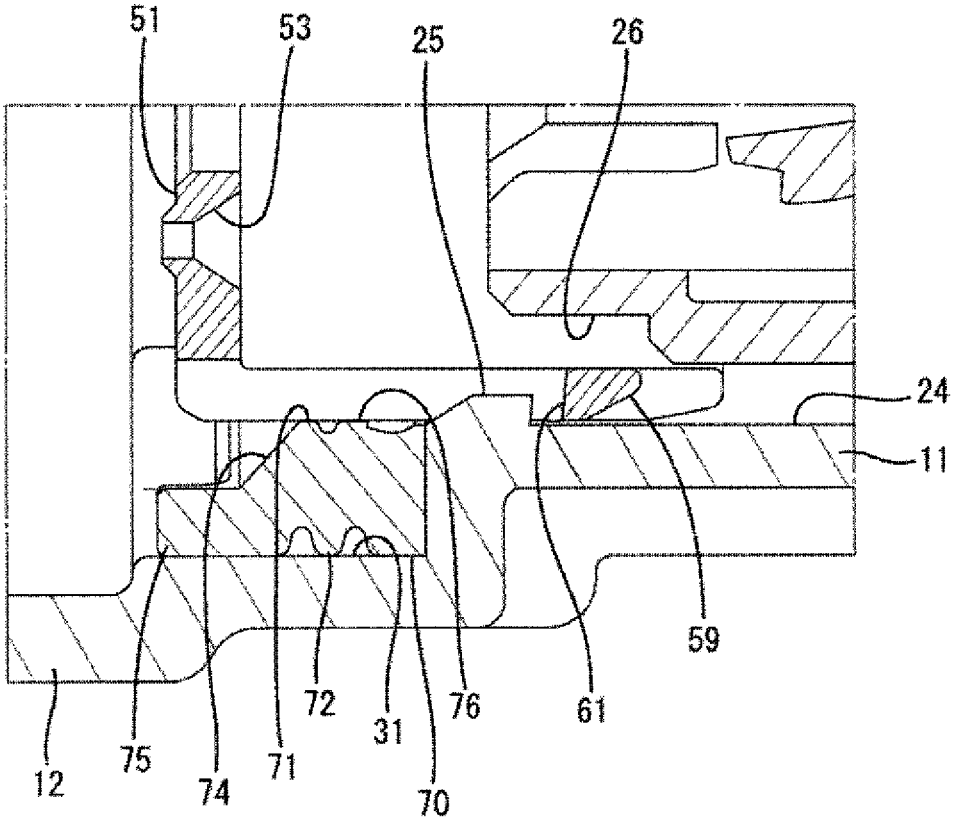
FIG. 8 is an enlarged section showing a state where a stopper enters a stopper receiving portion to restrict a forward movement of the moving plate.

As shown in FIG. 3, the housing body 11 includes an insertion recess 24 collectively surrounding upper and lower parts including the cavities 13 and the first and second sub-housing accommodating portions 14, 15 in a front view in an outer periphery of the front surface. The insertion recess 24 is a rectangular groove with four arcuately curved corners in a front view. The housing body 11 includes stoppers 25 paired in the width direction and projecting on upper and lower outer side surfaces of the insertion recess 24. As shown in FIG. 8, the front surface of the stopper 25 is shaped into a slope inclined rearwardly toward a tip in a projecting direction. The rear surface of the stopper 25 is formed into an overhanging shape inclined rearward toward the tip in the projecting direction. The housing body 11 includes escaping portions 26 recessed inward in a stepped manner at positions facing the stoppers 25 on upper and lower inner side surfaces of the insertion recess 24.

The receptacle 12 includes side walls facing each other in the width direction and extending along the vertical direction and upper and lower walls facing each other in the vertical direction and extending along the width direction. As shown in FIG. 3, the receptacle 12 includes cylindrical cam followers 27 in vertically intermediate parts of the inner surfaces of the respective side walls. The cam followers 27 enter the respective cam grooves 242 of the lever 240 and slide in contact with surfaces of the respective cam grooves 242 as the lever 240 is rotated. A cam action is exhibited by the sliding contact of the cam followers 27 with the groove surfaces of the cam grooves 242. In this way, the housings 10, 210 are connected and separated with a small connection/separation force.

The receptacle 12 includes a lock mounting portion 28 formed by cutting an inner surface side of a front part of the lower wall. A lock 30 (see FIGS. 1 and 6) made of metal is mounted into the lock mounting portion 28. The housing 10 is inserted into a mounting hole 110 in the panel 100 and the lock 30 is locked to an opening edge of the mounting hole 110 so that the housing 10 is retained and mounted on the panel 100.

As shown in FIG. 9, the receptacle 12 includes a step 29 extending along a radial direction on a back part near the housing body 11. A region of the receptacle 12 located on a back side across the step 29 is reduced in diameter more than a region located on an opening side (front side) to form a seal accommodating portion 31 between the insertion recess 24 of the housing body 11 and the receptacle 12. The seal 70 is inserted and accommodated into the seal accommodating portion 31.

In the seal accommodating portion 31, an inner peripheral region on the back side of the receptacle 12 is arranged along the front-rear direction, and an outer peripheral region of the insertion recess 24 in the front surface of the housing body 11 is arranged along the vertical direction. The seal 70 is held in close contact with a range from the inner peripheral region on the back side of the receptacle 12 to the outer peripheral region of the insertion recess 24 in the front surface of the housing body 11.

As shown in FIG. 3, the receptacle 12 includes hooks 32 projecting inward from the step 29. Each hook 32 is a projecting piece arranged to partially close the front surface of the seal accommodating portion 31 and restricts a forward movement of the seal 70 from the seal accommodating portion 31 in a direction to escape from the receptacle 12 (see FIG. 6). In this embodiment, the hooks 32 are provided on four corner parts of the step 29 (seal accommodating portion 31) and on side surfaces of the step 29 (seal accommodating portion 31) paired in the width direction while being spaced apart in the vertical direction.

Further, as shown in FIGS. 1 and 6, the receptacle 12 includes a part expanded in diameter toward a radially outer side on a front-end outer periphery and a mounting groove 33 open in the front surface of that enlarged-diameter part. The panel seal 90 is inserted and accommodated into the mounting groove 33 of the receptacle 12.

<Terminal Fittings 40>

The terminal fitting 40 is formed, such as by bending a conductive metal plate and is elongated in the front-rear direction. As shown in FIG. 6, each terminal fitting 40 (excluding the coaxial terminals) includes a body 41, a tab 42 projecting forward from the body 41 and a barrel 43 connected behind the body 41. The barrel 43 is connected electrically and mechanically to an end part of a wire 80. The body 41 is inserted into the cavity 13 to be retained and locked, and the tab 42 projects into the receptacle 12.

<Moving Plate 50>

The moving plate 50 is made of synthetic resin, inserted into the receptacle 12 and arranged movably to a protection position (see FIG. 6) and a connection position (see FIG. 9) with respect to the housing 10. As shown in FIG. 1, the moving plate 50 includes a protection wall 51 arranged along the vertical direction and the width direction and a peripheral wall 52 projecting rearward from an outer peripheral part of the protection wall 51.

Figure 4:
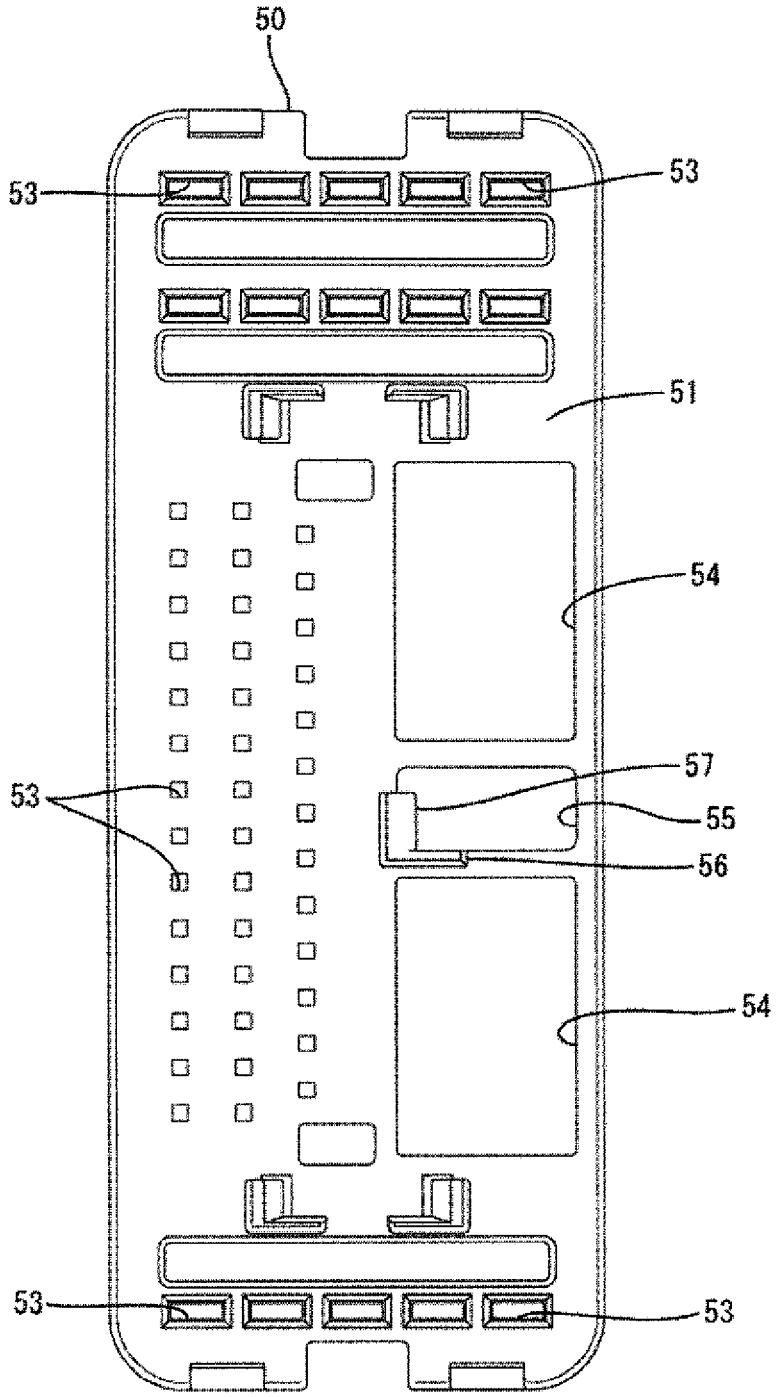
FIG. 4 is a front view of a moving plate.
Figure 5:
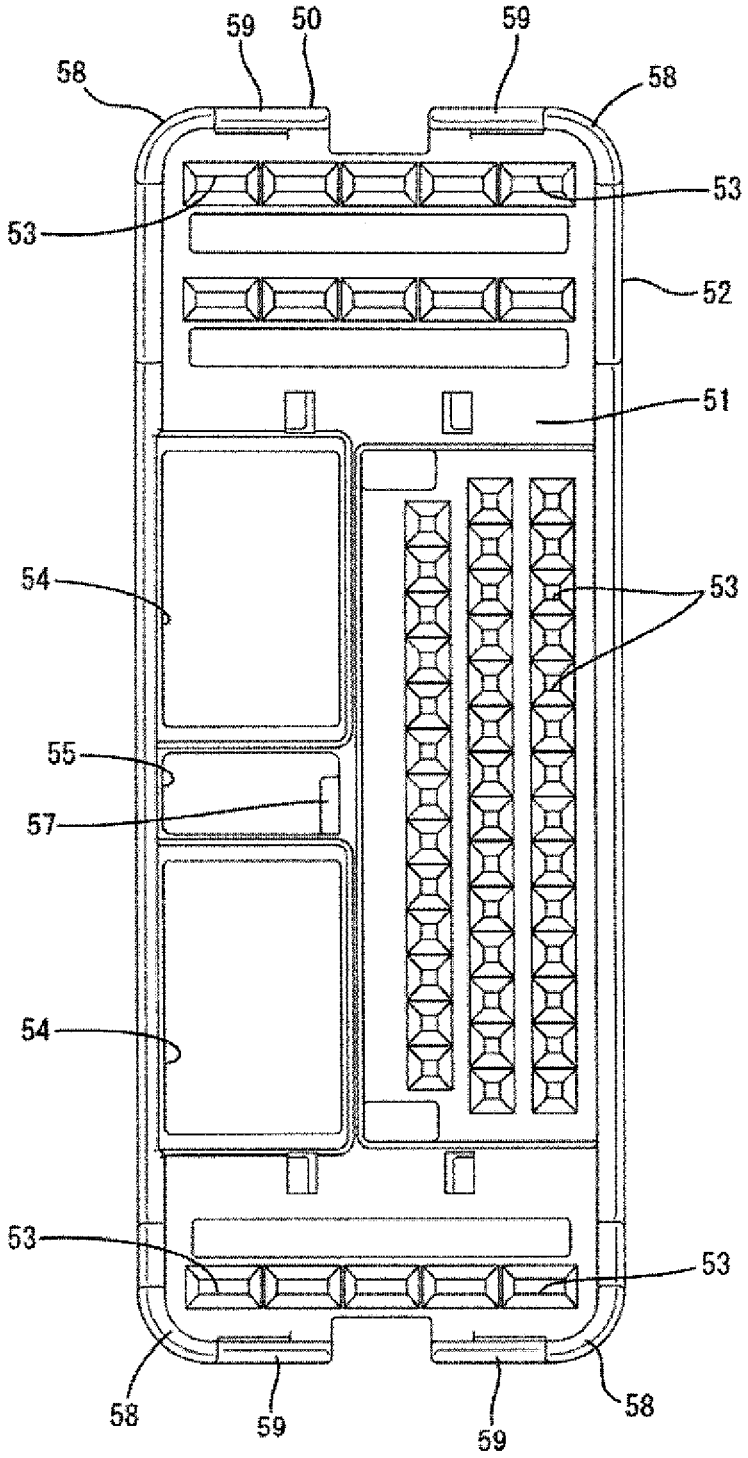
FIG. 5 is a back view of the moving plate.

The protection wall 51 is rectangular plate that is long in the vertically long in a front view and is arranged to cover the front surface of the housing body 11 in the receptacle 12. As shown in FIGS. 4 and 5, the protection wall 51 includes positioning holes 53 at positions corresponding to the respective cavities 13 in the upper and lower end parts of the housing body 11 and the respective cavities 13 of the first sub-housing 17. Each positioning hole 53 has a size and a shape so that the tab 42 of the terminal fitting 40 is insertable therein. The protection wall 51 includes housing insertion holes 54 at positions corresponding to the second sub-housing accommodating portions 15. Each housing insertion hole 54 has a vertically long rectangular opening, and a tubular part of the second sub-housing 18 is inserted inside.

The protection wall 51 includes a through hole 55 between the respective housing insertion holes 54. The through hole 55 has a wide rectangular opening, and the projecting portion 19 and the locking arm 21 are collectively inserted inside.

As shown in FIGS. 4 and 7, the protection wall 51 includes a base 56 L-shaped in a front view and projecting forward from two side edges extending across a corner on a center lower side of the through hole 55 in the front surface. The base 56 includes a rib-like locking portion 57 extending in the vertical direction on a tip part. The rear surface of the locking portion 57 has an overhanging shape inclined rearward toward a tip in a projecting direction. As shown in FIG. 6, a movement of the moving plate 50 from the protection position to the connection position is restricted by the contact of the rear surface of the locking portion 57 with the locking surface 23 of the locking arm 21.

As shown in FIG. 5, the peripheral wall 52 is connected to the outer peripheral part of the protection wall 51 except widthwise middle parts of upper and lower ends. The outer peripheral surface of the peripheral wall 52 is arranged along the front-rear direction to face the inner peripheral surface of the seal 70. The peripheral wall 52 includes projecting pieces 58 projecting rearward on four corner parts. The projecting pieces 58 are arcuate in a back view to correspond to the curved shape of the four corner parts. The projecting pieces 58 are inserted deep into the four corner parts of the insertion recess 24 of the housing body 11 to restrict inclination of the moving plate 50 about an axis in the receptacle 12.

The peripheral wall 52 includes plate pieces 59 connected to the projecting pieces 58 and extending along the width direction on both widthwise ends of the upper and lower ends. As shown in FIG. 1, the plate piece 59 includes a stopper receiving portion 61 in the form of a long hole extending in the front-rear direction in a central part and having a front end open in the front surface of the protection wall 51 and a closed rear end. As shown in FIG. 8, the rear end surface of the stopper receiving portion 61 is inclined rearwardly toward an outer side. The stoppers 25 are inserted into the stopper receiving portions 61 of the peripheral wall 52. A forward movement of the moving plate 50 from the protection position in the direction to escape from the receptacle 12 is restricted by the contact of the rear end surfaces of the stopper receiving portions 61 with the rear surfaces of the stopper portions 25.

<Seal 70>

The seal 70 is made of rubber, such as silicon rubber, and, as shown in FIG. 6, is accommodated into the seal accommodating portion 31 and is arranged along the inner periphery of the back side of the receptacle 12. As shown in FIG. 1, the seal 70 has a vertically long rectangular shape in front view with four arcuately curved corner parts. The seal 70 is formed to have a predetermined thickness in the front-rear direction and includes front and rear inner peripheral lips 71 on an inner peripheral surface and front and rear outer peripheral lips 72 on an outer peripheral surface. The inner peripheral lips 71 and the outer peripheral lips 72 are formed at different phases in the front-rear direction. Each inner peripheral lip 71 and each outer peripheral lip 72 is provided over the entire periphery on the inner and outer peripheral surfaces of the seal 70.

As shown in FIG. 1, the seal 70 includes lateral parts facing each other in the width direction and extending along the vertical direction and rib-like protrusions 73 connected to the rear ends of the lateral parts and extending in the vertical direction. As shown in FIG. 6, the protrusion 73 has a rectangular cross-sectional shape and is fit and held in close contact with the range from the inner peripheral region on the back side of the receptacle 12 to the outer peripheral region of the insertion recess 24 in the front surface of the housing body 11.

As shown in FIG. 8, the seal 70 has a slope 74 widened toward an outer side on the front surface of the inner peripheral lip 71 on a front end. A front part of the seal 70 is thinner than a rear part by the slope 74. Further, the seal 70 includes extending portions 75 projecting forward from appropriate positions circumferentially spaced apart. Each extending portion 75 is in close contact with the inner peripheral region on the back side of the receptacle 12 in a front part of the seal accommodating portion 31.

<Panel Seal 90>

The panel seal 90 is made of rubber, such as silicon rubber, and, as shown in FIG. 6, is accommodated into the mounting groove 33 of the receptacle 12. The panel seal 90 has a rectangular annular shape one size larger than the seal 70 in a front view. The panel seal 90 includes a rear lip 91 projecting rearward and to be held in close contact with the back surface of the mounting groove 33 and a front lip 92 projecting forward and to be held in close contact with an opening edge of the mounting hole 110 in the plate surface of the panel 100. The panel seal 90 is sandwiched resiliently between the housing 10 and the panel 100 via the front and rear lips 92, 91 to seal between the housing 10 and the panel 100 in a liquid-tight manner.

<Connector Connecting Structure>

Prior to connection to the mating connector 200, the seal member 70 is inserted into the receptacle 12 from the front. The seal 70 resiliently rides over the respective hooking portions 32 and is fit into the seal accommodating portion 31. The protrusions 73 are fit to the back side of the seal accommodating portion 31 and the rear end of the seal 70 contacts the outer peripheral region of the insertion recess 24 in the front surface of the housing body 11 to restrict a rearward movement of the seal 70. Further, a forward movement of the seal 70 is restricted by contact of the front end of the seal 70 with the hooks 32. In this way, movement of the seal 70 in the front-rear direction with respect to the seal accommodating portion 31 is restricted. As just described, the hooks 32 and the outer peripheral region of the insertion recess 24 in the front surface of the housing body 11 function as a restricting portion for restricting forward and rearward movements of the seal 70.

Subsequently, the moving plate 50 is inserted into the receptacle 12 from the front. In the process of inserting the moving plate 50, the respective plate pieces 59 slide in contact with the front surfaces of the respective stoppers 25 to be deflected and deformed into the escaping portions 26. If the plate pieces 59 ride over the respective stoppers 25 and resiliently return, the stoppers 25 are fit into the stopper receiving portions 61 of the respective plate pieces 59 (see FIG. 8). Forward movement of the moving plate 50 is restricted by the contact of the rear surfaces of the stopper receiving portions 61 of the plate pieces 59 with the rear surfaces of the respective stoppers 25. Further, the locking arm 21 is inserted into the through hole 55 of the protection wall 51, and the locking portion 57 contacts the locking surface 23 of the locking arm 21 so that a rearward movement of the moving plate 50 is restricted (see FIG. 7). In this way, the moving plate 50 is at the protection position with forward and rearward movements restricted. At the protection position, the projecting pieces 58 are inserted into the insertion recess 24 of the housing body 11 (see FIG. 6). Further, at the protection position, the protection wall 51 is arranged in front of and at a distance from the front surface of the housing body 11 in the receptacle 12.

In a state where the moving plate 50 is at the protection position and each terminal fitting 40 is accommodated in each cavity 13, the tip of the tab 42 of each terminal fitting 40 is positioned and inserted into each positioning hole 53 of the protection wall 51. In this way, external matter cannot interfere with the tips of the tabs 42 and inadvertent deformation of the tabs 42 is prevented. Further, at the protection position, the projection 19 passes through the through hole 55 of the protection wall 51 and projects into the receptacle 12. If an attempt is made to fit the mating housing 210 into the receptacle 12 in an improper posture inclined from a proper posture, the tip of the projection 19 butts against the front surface (front surface when viewed from the mating housing 210) of the mating housing 210 to avoid interference of the mating housing 210 with the protection wall 51 and the tips of the tabs 42.

Further, when the moving plate 50 is at the protection position, the peripheral wall 52 faces the inner peripheral surface of the seal 70. The peripheral wall 52 faces the inner peripheral surface of the seal 70 over the entire length in the front-rear direction except at parts of the upper and lower ends and cover a sealing surface 76 of the seal 70. Further, the outer peripheral surface of the peripheral wall 52 contacts the tip of each inner peripheral lip 71 of the seal 70. In this way, foreign matter, such as dust and dirt, cannot adhere to the inner peripheral surface (including the sealing surface 76) of the seal 70.

The connector is connected to the mating connector 200 while being mounted on the panel 100. If the mating connector 200 is inserted into the receptacle 12 in an initial stage of connection, each cam follower 27 enters the entrance of each cam groove 242 of the lever 240. Further, if the mating connector 200 is inserted into the receptacle 12, the releasing portion of the mating housing 210 slides in contact with the release guiding surface 22, the locking arm 21 is deflected and deformed and the locking portion 57 is separated from the locking surface 23 of the locking arm 21. In this way, the moving plate 50 can move to the connection position. Subsequently, the lever 240 is rotated. When a connecting operation of the housings 10, 210 proceeds, the moving plate 50 is pressed by the mating housing 210 to move toward the connection position. The protection wall 51 moves rearward toward the front surface of the housing body 11. During this time, each projecting piece 58 and the peripheral wall 52 are inserted deep into the insertion recess 24 and each stopper 25 is displaced in each stopper receiving portion 61 to guide a moving operation of the moving plate 50.

While the moving plate 50 is moving toward the connection position, the peripheral wall 52 is displaced away from the sealing surface 76 of the seal 70. In the process of moving the peripheral wall 52 away from the sealing surface 76 of the seal 70, the guiding surface 213 of the mating housing 210 slides in contact with the slope 74 of the seal 70. Thereafter, the peripheral wall 52 is released from a contact state with each inner peripheral lip 71 and, subsequently, the seal receiving surface 212 of the mating housing 210 contacts the tip of each inner peripheral lip 71 (see FIG. 9). Here, the seal receiving surface 212 of the mating housing 210 is located radially outwardly of the outer peripheral surface of the peripheral wall 52. Thus, a deformation amount of each inner peripheral lip 71 contacting the seal receiving surface 212 of the mating housing 210 to be squeezed is larger than that of each inner peripheral lip 71 contacting the outer peripheral surface of the peripheral wall 52 to be deformed.

When each cam follower 27 reaches the back side of each cam groove 242 and the both housings 10, 210 are properly connected, the protection wall 51 approaches such a position as to be able to contact the front surface of the housing body 11 and is sandwiched between the housing body 11 and the mating housing 210 (see FIG. 9). At this time, the tab 42 of each terminal fitting 40 largely projects forward from the protection wall 51 and is inserted into the mating housing 210 to be electrically connected to the mating terminal fitting 250. Then, the projecting portion 19 enters the receiving portion 211 of the mating housing 210.

When the housings 10, 210 are connected properly, the moving plate 50 reaches the connection position. When the moving plate 50 is at the connection position, the seal receiving surface 212 of the mating housing 210 faces the sealing surface 76 of the seal 70 and is resiliently in close contact with each inner peripheral lip 71. In this way, sealing is provided between the housings 10, 210 in a liquid-tight manner. Further, when the moving plate 50 is at the connection position, a front part of the peripheral wall 52 partially faces and contacts a rear end part of the inner peripheral surface of the seal 70.

As described above, according to this embodiment, the moving plate 50 faces the sealing surface 76 of the seal 70 to protect the sealing surface 76 before the connection of the housings 10, 210. Thus, foreign matter, such as dust and dirt, cannot adhere to the sealing surface 76. As a result, a state where the seal 70 is in close contact with the mating housing 210 can be satisfactorily realized and predetermined sealing can be ensured.

The moving plate 50 is pressed by the mating housing 210 to move away from the sealing surface 76. Thus, a special working process for moving the moving plate 50 is not necessary and work efficiency is improved. The moving plate 50 has a function of protecting the tips of the tabs 42 in addition to a function of protecting the seal 70, the structure of the connector can be simplified as compared to the case where both functions are provided in separate members.

Further, since the receptacle 12 includes the outer peripheral region of the insertion recess 24 in the front surface of the housing 10 and the respective hooks 32, forward and rearward movements of the seal 70 are restricted. Thus, inadvertent deviations in position of the sealing surface 76 of the seal 70 and the seal receiving surface 212 of the mating housing 210 can be prevented.

Further, since a deformation amount of the seal 70 held in close contact with the mating housing 210 to be deformed resiliently is larger than that of the seal 70 deformed by the contact of the peripheral wall 52 of the moving plate 50 with the sealing surface 76 of the seal 70 at the protection position, the seal 70 is not deformed more than necessary by the peripheral wall 52 and a resilient sealing force of the seal 70 will not decrease.

The embodiment disclosed is illustrative rather than restrictive in all aspects. Some other embodiments are described below Although the moving member is constituted by the moving plate 50 in the above embodiment, the moving member is not limited to the moving plate 50 and, for example, a dedicated moving member for protecting the sealing surface at a position facing the sealing surface of the seal 70 may be used as another embodiment. Further, the moving member may be a retainer movable from a partial locking position separated from the front surface of a housing body to a full locking position near the front surface of the housing body and configured to retain terminal fittings at the full locking position. In this case, the retainer may include a part facing the sealing surface of the seal at the partial locking position.

Although the seal 70 is arranged along the inner peripheral surface of the receptacle 12 in the case of the above embodiment, a seal may be arranged along the outer peripheral surface of a housing as another embodiment. In this case, a dedicated moving member may be arranged to face the outer peripheral surface of the seal before the connection of both housings.

Although the moving plate 50 serving as the moving member is in contact with the sealing surface 76 of the seal 70 before the connection of the housings 10, 210 in the case of the above embodiment, a moving member may be arranged away from a sealing surface of a seal before the connection of both housings.

LIST OF REFERENCE SIGNS

10 . . . housing
11 . . . housing body
12 . . . receptacle
13 . . . cavity
14 . . . first sub-housing accommodating portion
15 . . . second sub-housing accommodating portion
16 . . . housing lock
17 . . . first sub-housing
18 . . . second sub-housing
19 . . . projection
21 . . . locking arm
22 . . . release guiding surface
23 . . . locking surface
24 . . . insertion recess
25 . . . stopper
26 . . . escaping portion
27 . . . cam follower
28 . . . lock mounting portion
29 . . . step
30 . . . lock
31 . . . seal accommodating portion
32 . . . hook (restricting portion)
33 . . . mounting groove
40 . . . terminal fitting
41 . . . body
42 . . . tab
43 . . . barrel
50 . . . moving plate
51 . . . protection wall
52 . . . peripheral wall
53 . . . positioning hole
54 . . . housing insertion hole
55 . . . through hole
56 . . . base
57 . . . locking portion
58 . . . projecting piece
59 . . . plate
61 . . . stopper receiving portion
70 . . . seal
71 . . . inner peripheral lip
72 . . . outer peripheral lip
73 . . . protrusion
74 . . . slope
75 . . . extending portion
76 . . . sealing surface
80 . . . wire
90 . . . panel seal member
91 . . . rear lip
92 . . . front lip
100 . . . panel
110 . . . mounting hole
200 . . . mating connector
210 . . . mating housing

211 . . . receiving portion
212 . . . seal receiving surface
213 . . . guiding surface
220 . . . grommet
224 . . . covering portion
225 . . . pipe
230 . . . grommet cover
240 . . . lever
241 . . . cam plate
242 . . . cam groove
250 . . . mating terminal fitting

What is claimed is:

1. A connector, comprising:

a housing having opposite front and rear ends and a receptacle extending rearward into the front end, the receptacle being configured to receive a mating housing inserted in a front to rear direction;

a seal mounted into the housing, the seal having an inwardly facing sealing surface to be held in close contact with an outer peripheral surface of the mating housing; and a moving member movable rearward with respect to the housing from a protection position before connection of the housing and the mating housing to a connection position after connection of the housing and the mating housing, wherein:

an outer peripheral surface of the moving member faces the sealing surface of the seal when the moving member is in the protection position and before connection of the housing and the mating housing, and the sealing surface of the seal closely contacts the outer peripheral surface of the mating housing when the mating housing is inserted into the receptacle and the movable member is moved to the connection position.

2. The connector of claim 1, wherein a tab is arranged to project into the receptacle, the seal is arranged along an inner periphery of the receptacle, and the moving member is a moving plate to be assembled into the receptacle and includes a protection wall for protecting a tip part of the tab at a protection position before the connection of the housings and a peripheral wall facing the sealing surface on an outer peripheral side of the protection wall.

3. The connector of claim 2, wherein the housing includes a restricting portion for restricting forward and rearward movements of the seal in a moving direction of the moving member.

4. The connector of claim 3, wherein a deformation amount of the seal held in close contact with the mating housing to be resiliently deformed is larger than that of the seal when the moving member contacts the sealing surface of the seal before the connection of the housings.

5. The connector of claim 1, wherein the housing includes a restricting portion for restricting forward and rearward movements of the seal in a moving direction of the moving member.

6. The connector of claim 1, wherein a deformation amount of the seal held in close contact with the mating housing to be resiliently deformed is larger than that of the seal when the moving member contacts the sealing surface of the seal before the connection of the housings.

7. The connector of claim 1, wherein the housing includes a seal accommodating portion formed at a rear part of the receptacle, the seal being mounted into the seal accommodating portion.

8. The connector of claim 7 wherein the seal defines a continuous ring and has an outer peripheral surface engaged against an inner peripheral surface of the seal accommodating portion.

9. A connector assembly, comprising:

a housing having opposite front and rear ends and a receptacle extending rearward into the front end of the housing;

a mating housing configured to be inserted into the receptacle in a front to rear direction;

a seal mounted into the housing, the seal having an inwardly facing sealing surface to be held in close contact with an outer peripheral surface of the mating housing; and a moving member movable rearward with respect to the housing from a protection position before connection of the housing and the mating housing to a connection position after connection of the housing and the mating housing, wherein:

an outer peripheral surface of the moving member faces the sealing surface of the seal when the moving member is in the protection position and before connection of the housing and the mating housing, and the sealing surface of the seal closely contacts the outer peripheral surface of the mating housing when the mating housing is inserted into the receptacle and the movable member is moved to the connection position.

10. The connector assembly of claim 9, wherein a tab is arranged to project into the receptacle, the seal is arranged along an inner periphery of the receptacle, and the moving member is a moving plate to be assembled into the receptacle and includes a protection wall for protecting a tip part of the tab at a protection position before the connection of the housings and a peripheral wall facing the sealing surface on an outer peripheral side of the protection wall.

11. The connector of claim 9, wherein the housing includes a restricting portion for restricting forward and rearward movements of the seal in a moving direction of the moving member.

12. The connector assembly of claim 9, wherein a deformation amount of the seal held in close contact with the mating housing to be resiliently deformed is larger than that of the seal when the moving member contacts the sealing surface of the seal before the connection of the housings.

13. The connector assembly of claim 9, wherein the housing includes a restricting portion for restricting forward and rearward movements of the seal in a moving direction of the moving member.

14. The connector assembly of claim 9, wherein a deformation amount of the seal held in close contact with the mating housing to be resiliently deformed is larger than that of the seal when the moving member contacts the sealing surface of the seal before the connection of the housings.

15. The connector assembly of claim 9, wherein the housing includes a seal accommodating portion formed at a rear part of the receptacle, the seal being mounted into the seal accommodating portion.

16. The connector assembly of claim 15 wherein the seal defines a continuous ring and has an outer peripheral surface engaged against an inner peripheral surface of the seal accommodating portion.

* * * * *